United States Patent [19]

Mantz

[11] 4,065,126

[45] Dec. 27, 1977

[54] PRACTICE TENNIS BALL AND APPARATUS

[76] Inventor: David Mantz, 7950 Henry Ave., Philadelphia, Pa. 19128

[21] Appl. No.: 591,858

[22] Filed: June 30, 1975

[51] Int. Cl.[2] ..... A63B 37/12

[52] U.S. Cl. ..... 273/58 A; 273/29 A; 273/58 BA; 273/61 B

[58] Field of Search ..... 273/29 A, 38 A, 38 R, 273/61 R, 102.1 CM, 106.5 R, 106.5 B, 58 R, 58 B, 58 C, 58 D, 61 B

[56] References Cited

U.S. PATENT DOCUMENTS

| | | | |
|---|---|---|---|
| 532,700 | 1/1895 | Davids | 273/106.5 R |
| 600,967 | 3/1898 | Mead | 273/58 C |
| 929,013 | 7/1909 | Reach | 273/58 A |
| 978,250 | 12/1910 | Whitleg | 273/58 A |
| 2,105,861 | 1/1938 | Klecka | 273/58 X |
| 2,242,455 | 5/1941 | Beer | 273/58 A |
| 2,257,252 | 9/1941 | Vorbusch | 273/58 A |
| 2,278,292 | 3/1942 | Voit et al. | 273/58 A |
| 2,772,882 | 12/1956 | Anson | 273/58 C |
| 2,815,211 | 12/1957 | Grandinette | 273/58 A |
| 2,925,273 | 2/1960 | Pratt | 273/58 A X |
| 3,428,314 | 2/1969 | Haines et al. | 273/61 R |
| 3,563,544 | 2/1971 | Hedrick | 273/29 A |

*Primary Examiner*—William H. Grieb
*Assistant Examiner*—T Brown
*Attorney, Agent, or Firm*—Seidel, Gonda & Goldhammer

[57] ABSTRACT

A practice tennis ball and apparatus including a soft spherical member comprising a sewn cotton jacket enclosing a soft, cotton thread waste interior. A knit cover overfits the sewn jacket and may receive a marking powder suitable to removably indicate a contact upon a surface when the ball is in play. The knit cover removably overfits the sewn jacket to facilitate insertion of additional applications of marking powder. The apparatus includes targets in form suitable for application upon a vertical surface to receive the soft, pliable ball as it is propelled by a tennis racket.

3 Claims, 5 Drawing Figures

PRACTICE TENNIS BALL AND APPARATUS

BACKGROUND OF THE INVENTION

The invention relates generally to game apparatus suitable for practice purposes, and more particularly, is directed to a practice tennis ball and apparatus usable therewith.

In playing almost any sport, it is necessary to practice for extended periods of time in order to become proficient in the sport and to retain the ability to play satisfactorily. Of course, the best method of practice is to actually engage in the sport under actual field conditions. That is, using the game of tennis as an example, to practice upon an actual tennis court using tennis balls. While such practice conditions are generally available in mild weather seasons, in many instances, actual practice on a tennis court would be impossible due to cold, wind, rain and other inclement weather conditions. Other considerations such as time limitations, court availability and so forth also contribute to the need for adequate alternate practice facilities. Because of this, simulated playing apparatus which closely approximates actual strokes, phythm, position and pace incident to tennis strokes, such as the serve, become most important.

Prior workers in the art have approached the problem from various angles and have developed devices which have been more or less successful in meeting the objectives. In U.S. Pat. No. 2,247,072, a tennis stroke practice device has been disclosed wherein brackets suspend tennis balls on elastic cords wherein the balls are adjustable along the cord to accommodate the various persons using the device.

In U.S. Pat. No. 2,272,765, a tennis practice device has been disclosed wherein a pedestal is inflated to hold a tennis ball for practice purposes. A target ball is integral with the inflatable member and may be utilized either by itself or may be provided with rubber cups upon which can be seated a conventional tennis ball. The target ball is placed so that it will be first contacted by the racket and the carrying forward the stroke will the racket into contact with the free tennis ball. U.S. Pat. No. 3,709,490 discloses a training apparatus including a racket having a rubber line connected to a ball wherein the ball can be first thrown upwardly and then struck by the racket for tennis stroke practice purposes.

U.S. Pat. Nos. 2,706,514 and 3,396,970 show tennis ball constructions wherein the manufactured balls may be employed for practice purposes.

SUMMARY OF THE INVENTION

The present invention relates generally to the field of tennis practice devices, and more particularly, is directed to a soft practice tennis ball and target apparatus used in conjunction therewith.

A practice tennis ball of the present invention includes a soft, pliable core which is preferably fabricated of cotton thread waste packed in the form of a spherical shape. A sewn cotton cover encloses the cotton thread waste core and serves to maintain the spherical shape and the soft, pliable nature of the material. A knit or other material cover removably encloses the sewn cover and may be either sewn over the cover or removably affixed thereto such as by means of an elastic band. A powder which may be colored is applied to the knitted cover and is suitable to permiate therethrough when the ball is driven onto a target to thereby indicate the exact location of the ball in a semi-permanent manner when the ball strikes a target. The soft nature of the practice ball keeps rebounds to a minimum to to thereby permit practice in areas that are relatively small. Targets in the form of planar materials suitable to be applied against a vertical surface, for example a wall, are also included in the game apparatus and are provided with facilities to affix the targets to the wall surface. In order to use the game apparatus, the soft, pliable practice ball is stroked with a conventional tennis racket and is driven towards the target much in the same manner as striking an actual tennis ball. The feel, timing, rhythm, positioning and pace of actual tennis strokes can be simulated by employing the apparatus of the present invention. In this manner, a suitable practice can be enjoyed in confined areas such as a home or an office.

It is therefore an object of the present invention to provide an improved practice tennis ball and apparatus therefore.

It is another object of the present invention to provide a novel practice tennis ball of soft, pliable construction suitable for use in small areas.

It is another object of the present invention to provide a novel practice tennis ball of soft, pliable nature and including a powder marking system incorporated therewith.

It is another object of the present invention to provide a novel practice tennis ball and apparatus therefore including a soft, pliable ball construction and a target of planar configuration suitable for mounting upon a vertical surface.

It is another object of the present invention to provide a novel practice tennis ball and apparatus therefor that is inexpensive in manufacture, simple in construction and trouble free when in use.

Other objects and a fuller understanding of the invention will be had by referring to the following description and claims of a preferred embodiment thereof, taken in conjunction with the accompanying drawings wherein like reference characters refer to similar parts throughout the several views and in which:

DESCRIPTION OF THE PREFERRED EMBODIMENT OF THE INVENTION

Figure 1:
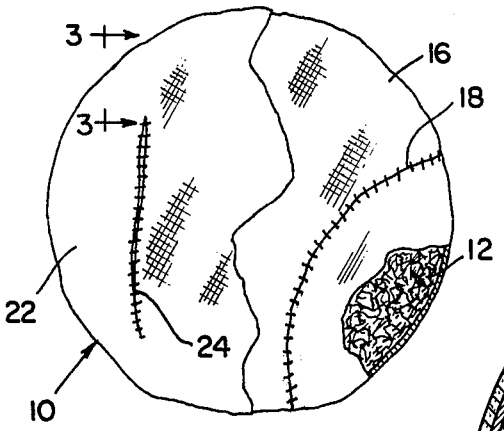
FIG. 1 is a perspective view of a practice tennis ball, partly broken away to disclose details of interior construction.

Although specific terms are used in the following description for the sake of clarity, these terms are intended to refer only to the particular structure of my invention selected for illustration in the drawings, and are not intended to define or limit the scope of the invention.

Referring now to the drawings, I show in FIG. 1 a practice tennis ball generally designated 10 which comprises generally an inner core of soft, pliable material 12 which may be cotton thread waste, foam rubber, natural sponge, foam plastic or similar soft, cellular material. The material 12 and the soft cover 16 should be suitable to receive repeated blows from a tennis racket 14, and to deaden the force of the blows so that the ball can be propelled indoors without damage and without undue bounce or ricochet.

The soft pliable material 12 forms a core portion which comprises essentially the entire interior of the ball 10 and this material is enclosed within a soft inner cover 16 which preferably is cut and sewn to a spherical shape to simulate an actual tennis ball. The soft cover 16 may be formed of any suitable soft, pliable, strong material such as cotton duck which is cut to shape and then sewn at the seams 18 to form a spherical enclosure. The soft cover 16 should be fabricated of material strong enough to withstand repeated impacts from the tennis racket 14 and repeated bounces against a vertical surface such as a wall 20 without permanent damage.

Figure 3:
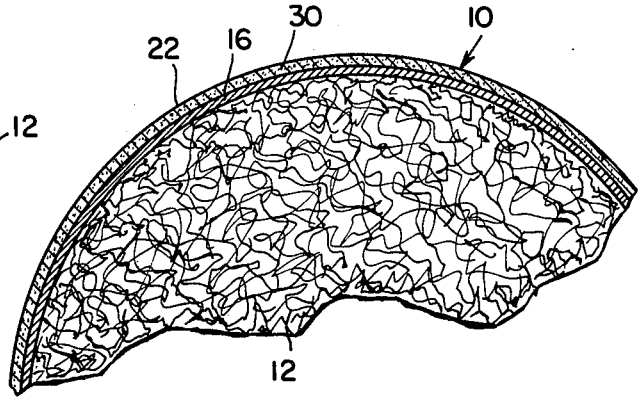
FIG. 3 is a partial, enlarged, sectional view taken along Line 33 of FIG. 1, looking in the direction of the arrows.

A knitted outer cover 22 encloses the soft cover 16 and is formed to the same general spherical shape and same general size to simulate an actual tennis ball. The cover 22 may be fabricated of material such as knitted wool or other yarn and preferably is pliable and somewhat stretchable such as a fabric knitted of wool or other yarn. The knitted cover 22 may be permanently affixed over the soft cover 16 by a sewn seam 24 as in FIG. 1 or may be removable in nature by fabricating the knitted cover 22 to a generally spherical configuration having an opening 26 suitable to removably receive therein the core material 12 and the sewn jacket or cover 16 in a removable manner therethrough. An elastic band or other closure material closes the knitted cover opening 26 after the core material 12 and the soft cover 16 have been applied interiorly of the knitted cover 22. A powder 30 is applied interiorly or exteriorly to the knitted cover 22 in a manner to permit the powder to permeate through the fabric comprising the cover 22 for the purposes hereinafter more fully explained. See FIG. 3.

Figure 4:
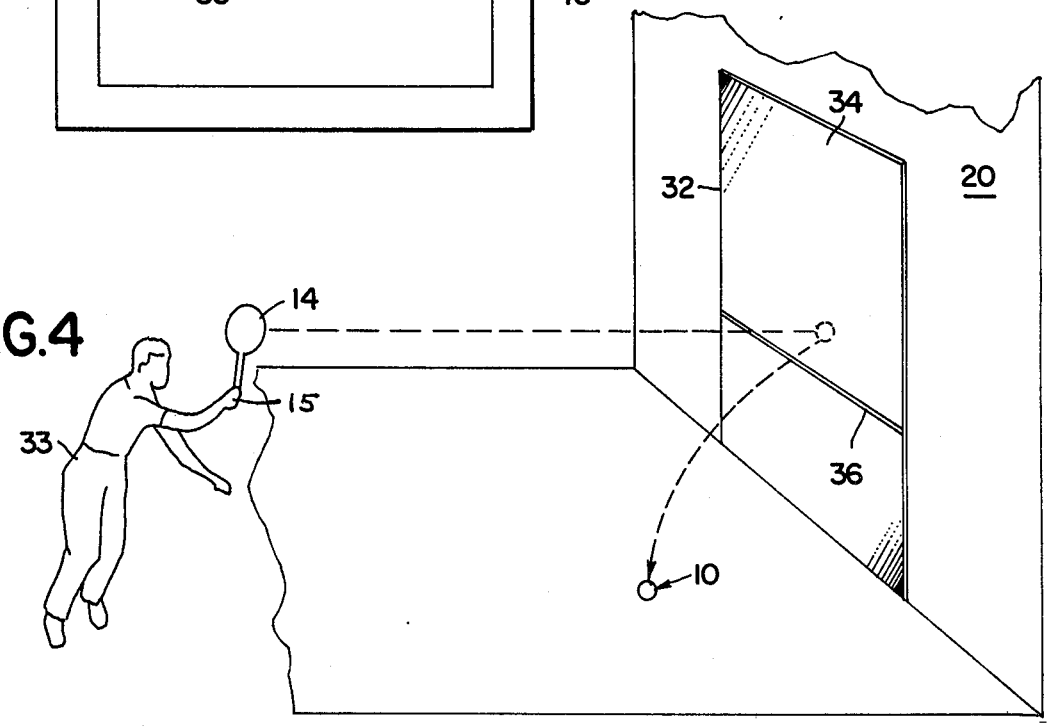
FIG. 4 is a perspective view showing a method of using the apparatus.

In order to use the practice tennis ball 10, as illustrated in FIG. 4, a target 32 may be applied directly upon a vertical surface such as a wall 20 to permit a player 34 to stroke the practice tennis ball 10 by utilizing a racket 14 in conventional manner. It is contemplated that the device will be particularly suitable for practicing serves in an indoor or other confined area.

In one configuration, the target 32 may include a mirror 34 so that the player can observe his form, stroke and position during all of the activities relating to the practice swing. A simulated net 36 which may be in the form of an adhesive coated tape can be applied horizontally across the mirror at a height corresponding to the usual tennis net. In a modification in the interest of economy, the simulated net 36 may be applied directly against the wall 20 at the desired height without employing the mirror 34.

Figure 5:
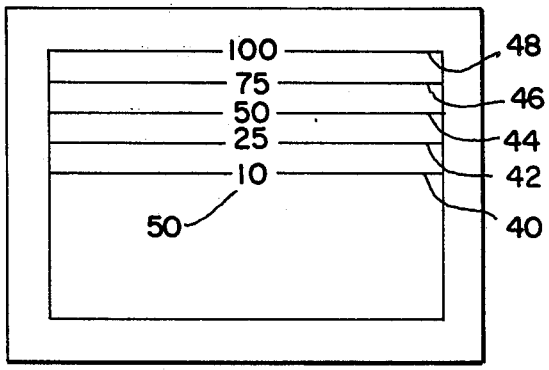
FIG. 5 is a front elevational view illustrating a modified target.
Figure 2:
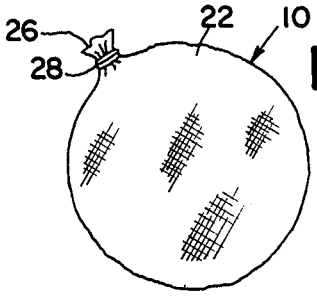
FIG. 2 is an elevational view showing a modified outer cover construction.

The same general type of apparatus can be developed in the form of a game board 38 as illustrated in FIG. 5. In this embodiment, the game board 38 should preferably be planar in nature and should be fabricated from any suitable material, for example, plywood, plastic or other planar material. The game board includes a plurality of horizontal lines 40, 42, 44, 46, 48 which are horizontally spaced and which may be marked with indicia 50 for value purposes in playing the game. It is contemplated that the lowest horizontal line 40 will correspond to the height of a usual tennis court net when the game board 38 is hung upon a wall 30, for example a height of approximately 36 inches.

In utilizing the game apparatus, the practice ball 10 may be simply driven with the racket 14 by the player 33 to practice the tennis stroke, timing, form, rhythm, etc. A vertical surface such as a wall may or may not be employed to limit the distance of travel of the ball. Optionally, a colored powder 30 can be applied to the practice ball 10 at the knitted outer cover 22 thereof in a manner to allow the powder 30 to permeate the cover 22. Accordingly, when the practice ball 10 is driven against a wall surface 20 or target 32 or game board 38, a portion of the powder will remain on the surface contacted by the ball to thereby give visual evidence as to the exact location where the ball was driven. Thus, the user can then adjust his actions during the practice session to direct the ball to the exact location desired.

It is also noteworthy that the practice ball 10 of the present invention can be used for play purposes without employing a racquet 14. For example, the practice ball can be struck directly with the hand 15 of the user to thereby gain a similar effect of practice as to rhythm, timing and pace without the need to use a racquet. The practice ball is soft in construction and because of this, will have no injurious effect when driven by the hand of the user.

Although I have described my invention with a certain degree of particularity, it is understood that the present disclosure has been made only by way of example and that numerous changes in the details of construction and the combination and arrangement of parts may be resorted to without departing from the spirit and scope of the invention as herein claimed.

I claim:

1. A practice playing ball comprising:

a soft inner core of pliable material;

an inner fabric cover surrounding and enclosing said inner core, said inner fabric cover being cut and sewn to enclose said inner core in a substantially spherical form;

a soft knitted fabric outer cover for enclosing said inner cover;

said soft knitted fabric outer cover having an opening through which said inner core and inner cover can be readily inserted and removed;

elastic means for securing said outer cover around said inner cover; and powdered chalk impregnated in said knitted fabric outer cover. for indicating a contact point of said ball on a surface rebounded thereagainst.

2. A practice playing ball in accordance with claim 1 wherein said pliable material is fabricated of materials selected from the group consisting of cellular material, cotton waste and plastic foam.

3. In a game apparatus, the combination comprising

A. a practice ball, 1. said ball comprising:

a soft inner core of pliable material;

an inner fabric cover surrounding and enclosing said inner core, said inner fabric cover being cut and sewn to enclose said inner core in a substantially spherical form;

a soft knitted fabric outer cover for enclosing said inner cover;

said soft knitted fabric outer cover having an opening through which said inner core and inner cover can be readily inserted and removed;

elastic means for securing said outer cover around said inner cover;

powdered chalk impregnated in said knitted fabric outer cover; and

B. a target positioned to be contacted by the ball, 1. said target including a horizontal line, whereby said powdered chalk is adapted to leave a mark on said target at the point of impact of said ball with said target.

* * * * *